US007413444B2

(12) United States Patent
Wang

(10) Patent No.: US 7,413,444 B2
(45) Date of Patent: Aug. 19, 2008

(54) CONNECTOR ASSEMBLY

(75) Inventor: Mei-Hui Wang, Hsin-Tien, Taipei Hsien (TW)

(73) Assignee: Advance Connectek Inc., Hsin-Tien, Taipei Hsien (TW)

( * ) Notice: Subject to any disclaimer, the term of this patent is extended or adjusted under 35 U.S.C. 154(b) by 1 day.

(21) Appl. No.: 11/732,189

(22) Filed: Apr. 2, 2007

(65) Prior Publication Data

US 2007/0275575 A1 Nov. 29, 2007

(30) Foreign Application Priority Data

May 26, 2006 (TW) ..... 95209178 U

(51) Int. Cl.
*H01R 12/00* (2006.01)

(52) U.S. Cl. ..... 439/74; 439/660

(58) Field of Classification Search ..... 439/74, 439/660, 862

See application file for complete search history.

(56) References Cited

U.S. PATENT DOCUMENTS 5,885,092 A * 3/1999 Ito et al. ..... 439/74
6,793,506 B1 * 9/2004 Hirata et al. ..... 439/74
6,811,411 B1 * 11/2004 Hirata et al. ..... 439/74
6,986,670 B2 * 1/2006 Okura et al. ..... 439/74

* cited by examiner

*Primary Examiner*—Briggitte R. Hammond
*Assistant Examiner*—Larisa Z Tsukerman
(74) *Attorney, Agent, or Firm*—Charles E. Baxley

(57) ABSTRACT

A connector assembly has a plug connector and a socket connector. The plug connector has a first insulative housing and at least one row of first terminals. The first terminals are mounted on the first insulative housing and each terminal has an inside contacting portion and an interference portion. The socket connector has a second insulative housing and at least one row of second terminals corresponding respectively to the at least one row of the first terminals. The second terminals are selectively engaged and respectively with the first terminals and each second terminal has an inner contacting portion and a shoulder portion. The inner contacting portion selectively contacts the inside contacting portion of one first terminal. The shoulder portion is selectively engaged with the interference portion of one first terminal and prevents the first terminal from disengaging inadvertently from the second terminal.

2 Claims, 7 Drawing Sheets

CONNECTOR ASSEMBLY

BACKGROUND OF THE INVENTION

1. Field of the Invention

The present invention relates to a connector assembly, and more particularly to a connector assembly that has a plug connector and a socket connector may be engaged securely with the plug connector.

2. Description of Related Art

Signal transmission between two printed circuit boards (PCBs) are implemented generally through a connector assembly having a plug connector on one PCB and a socket connector on the other PCB.

With reference to FIG. 9, a conventional connector 100 in accordance with the prior art comprises a plug connector 10 and a socket connector 20. The plug connector 10 has a row of first terminals. The socket connector 20 has a row of second terminals selectively contacting the row of the first terminal.

However, each first terminal contacts a corresponding second terminal merely in one single point without any locking structures. Therefore, the plug connector would be engaged loosely with and easily disengages inadvertently from the socket plug connector after repeated engagements and disengagements of the plug connector and the socket connector.

To overcome the shortcomings, the present invention provides a connector assembly to mitigate or obviate the aforementioned problems.

SUMMARY OF THE INVENTION

The main objective of the invention is to provide a connector assembly that has a plug connector and a socket connector may be engaged securely with the plug connector.

A connector assembly in accordance with the present invention comprises a plug connector and a socket connector. The plug connector has a first insulative housing and at least one row of first terminals. The first terminals are mounted on the first insulative housing and each terminal has an inside contacting portion and an interference portion. The socket connector has a second insulative housing and at least one row of second terminals corresponding respectively to the at least one row of the first terminals. The second terminals are selectively engaged respectively with the first terminals and each second terminal has an inner contacting portion and a shoulder portion. The inner contacting portion selectively contacts the inside contacting portion of one first terminal. The shoulder portion is selectively engaged with the interference portion of one first terminal and prevents the first terminal from disengaging inadvertently from the second terminal.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
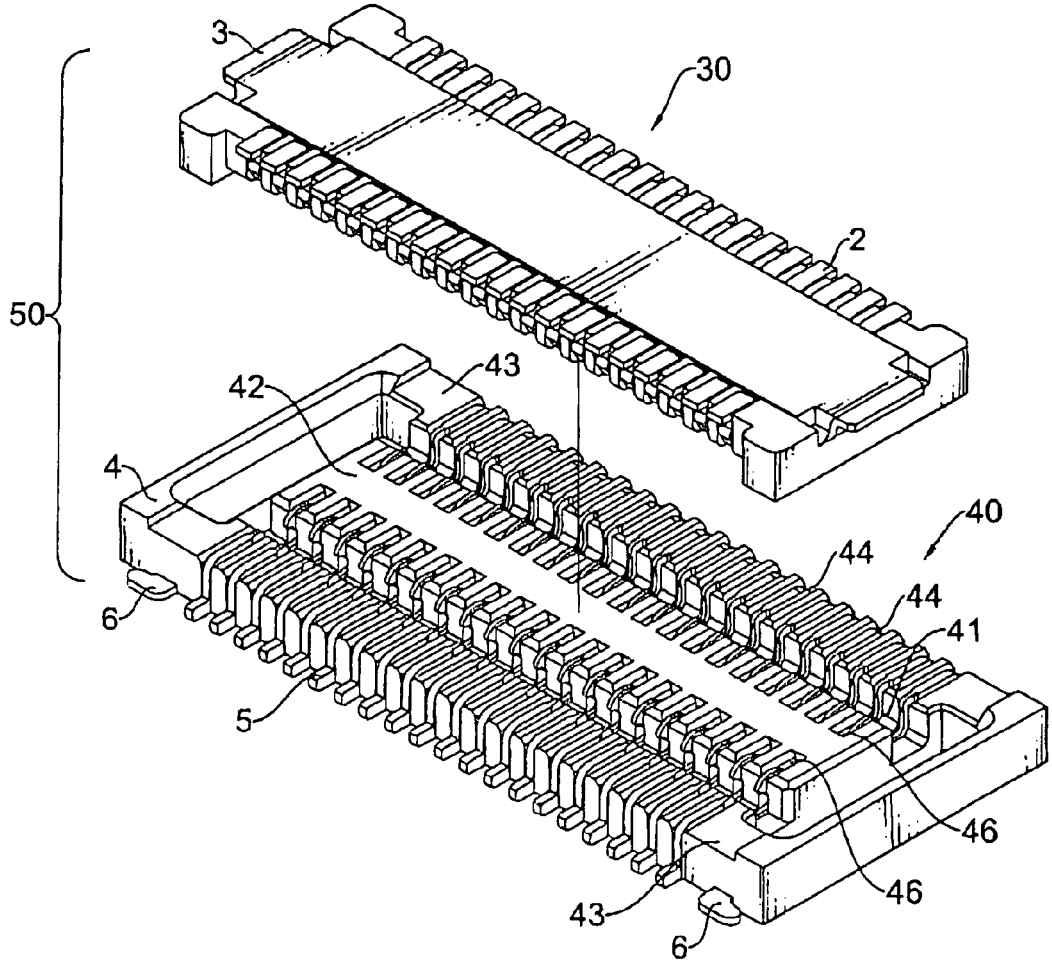
FIG. 1 is an exploded perspective view of a first embodiment of a connector assembly in accordance with the present invention.
Figure 2:
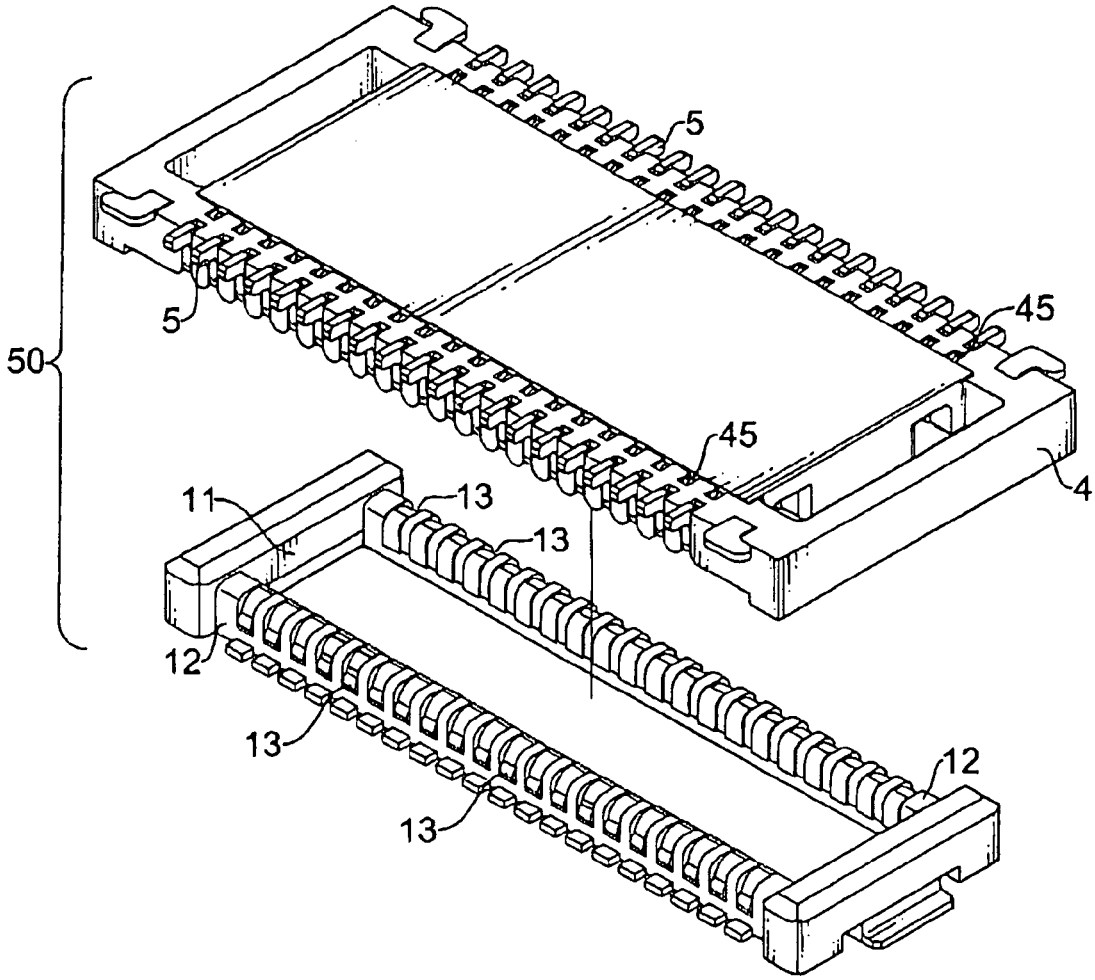
FIG. 2 is another exploded perspective view of the connector assembly in FIG. 1.

With reference to FIGS. 1 and 2, a first embodiment of a connector assembly 50 in accordance with the present invention is mounted between two printed circuit boards and comprises a plug connector 30 and a socket connector The plug connector 30 has a first insulative housing 1, two rows of first terminals 2 and two ground contacts 3.

The first insulative housing 1 has two ends, two opposite sides 12, a cavity 11 and two rows of mounting recesses 13. The cavity 11 is defined in the first insulative housing 1. The mounting recesses 13 of each row are defined in one of the side 13 and each mounting recess 13 has an inner surface 131.

Figure 3:
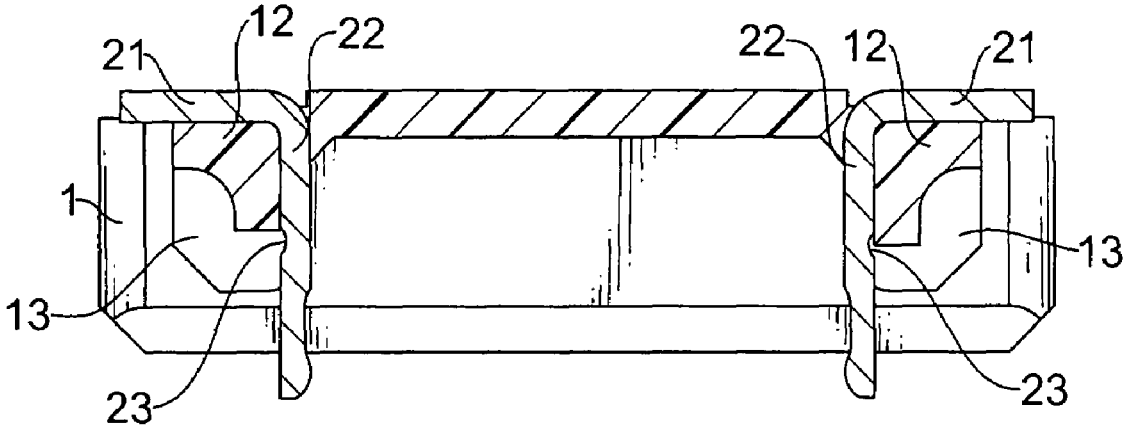
FIG. 3 is a cross sectional end view of the plug connector of the connector assembly in FIG. 1 with the semi-finished first terminals.
Figure 4:
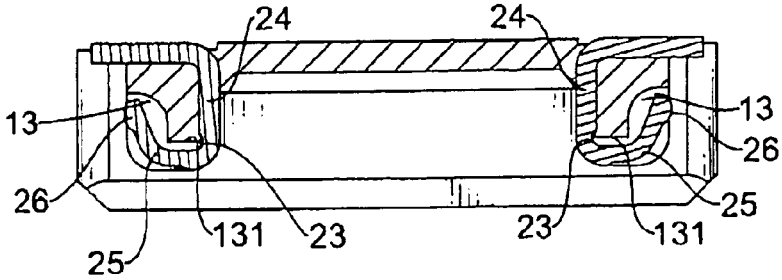
FIG. 4 is a cross sectional end view of the plug connector of the connector assembly in FIG. 3 with the finished first terminals.

With reference to FIGS. 3 and 4, the rows of the first terminals 2 correspond respectively to the sides 12 and the first terminals 2 of each row are mounted respectively in the mounting recesses 13 in a corresponding side 13 adjacent to the inner surface 131. Each first terminal 2 is formed from an L-shaped semi-finished first terminal having a soldering portion 21, a first body portion 22 and a curved and notched portion 23, as shown in FIG. 3. The first body portion 22 is formed on and protrudes perpendicularly from the soldering portion 21. The curved and notched portion 23 is defined the in the first body portion 22 and divide the first body portion 22 into an upper segment and a lower segment. The lower segment is then bent to form a resilient arm portion 25 and an interference portion 26 and the upper segment forms an inside contacting portion 24. Consequently, each finished first terminal 2 has the soldering portion and the first body portion 22. The first body portion 22 is formed on the soldering portion 21 and has the inside contacting portion 24, the resilient arm portion 25, the curved and notched portion 23 and the interference portion 26.

The inside contacting portion 24 is formed on and protrudes perpendicularly from the soldering portion 21.

The resilient arm portion 25 is formed on and protrudes perpendicularly from the inside contacting portion 24 and is parallel substantially to the soldering portion 21.

The curved and notched portion 23 is defined in first terminal 21 between the inside contacting portion 24 and the resilient arm portion 25.

The interference portion 26 is formed on and protrudes from the resilient arm portion 25 and is opposite to the inside contacting portion 24.

The ground contacts 3 are mounted respectively on the ends of the first insulative housing 1.

The socket connector 40 is engaged selectively with the plug connector and has a second insulative housing 4, two rows of second terminals 5 and two ground contacts 6.

Figure 5:
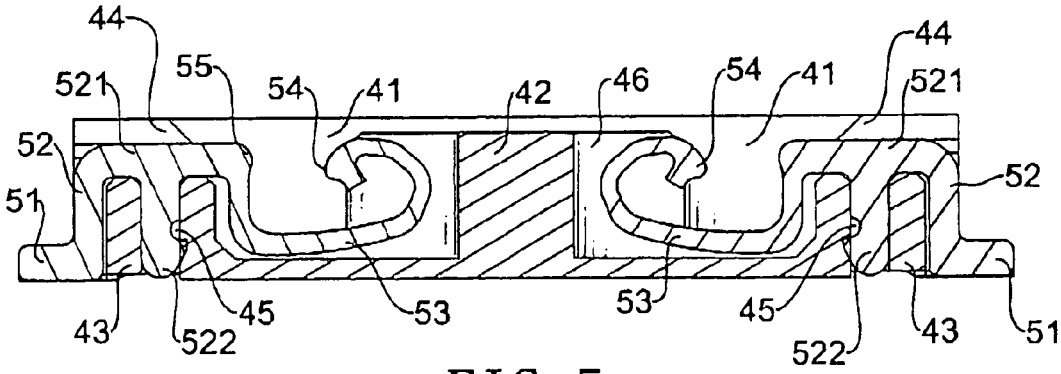
FIG. 5 is a cross sectional end view of the socket connector of the connector assembly in FIG. 1.

With reference to FIG. 5, the second insulative housing 4 has two ends, two opposite sides 43, a cavity 41, a ridge 42, two rows of mounting recesses 44 and two rows of through holes 45. Each side 43 has a top and a bottom. The cavity 41 is defined in the second insulative housing 4 and has an inner bottom surface. The ridge 42 is formed on and protrudes up from the inner bottom surface of the cavity 41 between the sides 43 of the second insulative housing 4, selectively extends in the cavity 11 in the first insulative housing 1 and has two opposite sidewalls and two rows of mounting slots 46. The mounting slots 46 of each row are defined in one of the sidewalls and each mounting slot 46 has 2 top opening. The rows of the mounting recesses 44 correspond respectively to the rows of the mounting slots 46. The mounting recesses 44 of each row are defined in the top of one of the sides 43 of the second insulative housing 4 and are aligned respectively with the mounting slots 46 of a corresponding row. The rows of the through holes 45 correspond respectively to the rows of the mounting slots 46. The through holes 45 of each row are defined through one side 43 of the second insulative housing 4 and are aligned respectively with the mounting slots of a corresponding row. Each through hole 45 has a top opening and a bottom opening.

Figure 6:
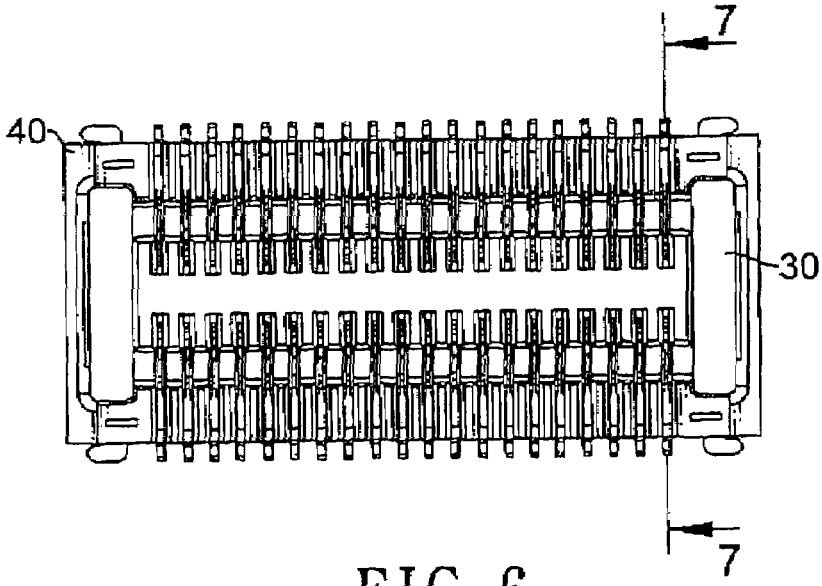
FIG. 6 is a top view of the connector assembly in FIG. 1 with the plug connector engaged with the socket connector.
Figure 7:
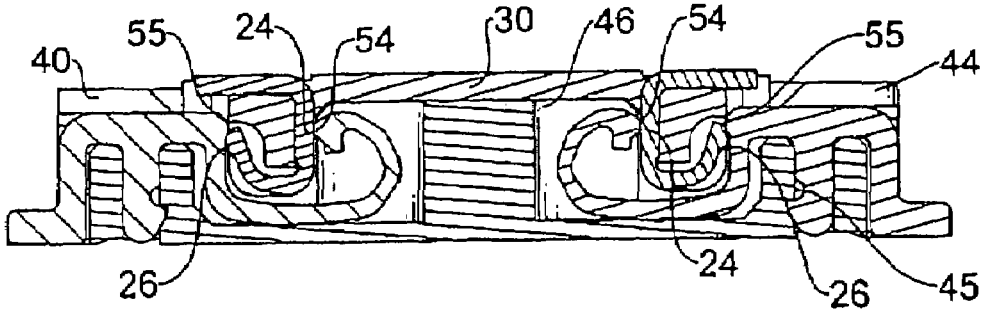
FIG. 7 is a cross sectional end view of the connector assembly in FIG. 6 along line 7-7.

With reference to FIGS. 6 and 7, the rows of the second terminals 5 correspond respectively the sides 43 of the second insulative housing 4, correspond respectively to the rows of the mounting slots 46, correspond respectively to the rows of the mounting recesses 44, correspond respectively to the rows of the through holes 45, and correspond respectively to the rows of the first terminals 2. The second terminals 5 of each row correspond respectively to and are mounted respectively in the through holes 45 of a corresponding row in a corresponding side 43 of the second insulative housing 4, correspond respectively to and are mounted respectively in the mounting recesses 44 of a corresponding row, correspond respectively to and respectively extend in the mounting slots 46 of a corresponding row, and correspond respectively to and are selectively engaged respectively with the first terminals 2 of a corresponding row. Each second terminal 5 has a soldering portion 51, a second body portion 52, a spiral arm portion 53, an inner contacting portion 54 and a shoulder portion 55.

The soldering portion 51 is located outside one of the side of the second insulative housing 4.

The second body portion 52 is m-shaped, is formed on the soldering portion 51, is mounted on a corresponding side 43 of the second insulative housing 4 and has a crossbar portion 521 and a mounting tab 522. The crossbar portion 521 is formed on and protrudes from the soldering portion 51. The mounting tab 522 is formed on and protrudes perpendicularly down from the crossbar portion 521 and is mounted in a corresponding through hole 45 through the top opening.

The spiral arm portion 53 is formed on and protrudes from the crossbar portion 521 of the second body portion 52. Further, it extends in a corresponding mounting slot 46 and has an upper distal end.

The inner contacting portion 54 is formed on the upper distal end of the spiral arm portion 53 and selectively contacts the inside contacting portion 24 of a corresponding first terminal 2.

The shoulder portion 55 is formed on and protrudes from the second body portion 52 of the second terminal 5, faces the inner contacting portion 54 and is engaged selectively with and locks the interference portion 26 on the corresponding first terminal 2. During the engagement of the corresponding first terminal 2 with the second terminal 5, the resilient arm portion 25 of the corresponding first terminal 2 is bent and squeezed while the interference portion 26 is passing through the shoulder portion 55 of the second terminal 5. After the interference portion 26 of the corresponding first terminal 2 crosses the shoulder portion 55, the resilient arm portion 25 expands and causes the interference portion 26 to be located under the shoulder portion 55 and therefore is blocked by the shoulder portion 55. Accordingly, the second terminal 5 is engaged securely with the corresponding first terminal 2.

The ground contacts 6 are mounted respectively on the ends of the second insulative housing 4.

Figure 8:
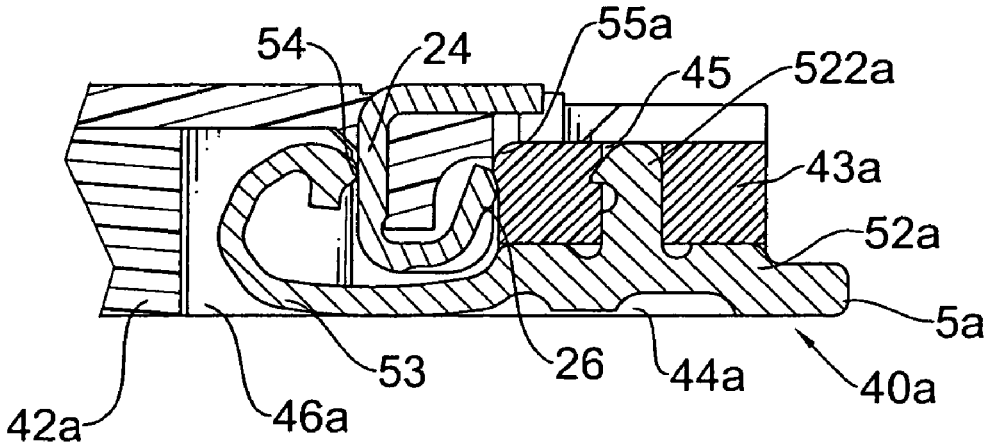
FIG. 8 is a cross sectional end view of a second embodiment of the connector assembly in accordance with the present invention with the plug connector engaged with the socket connector.
Figure 9:
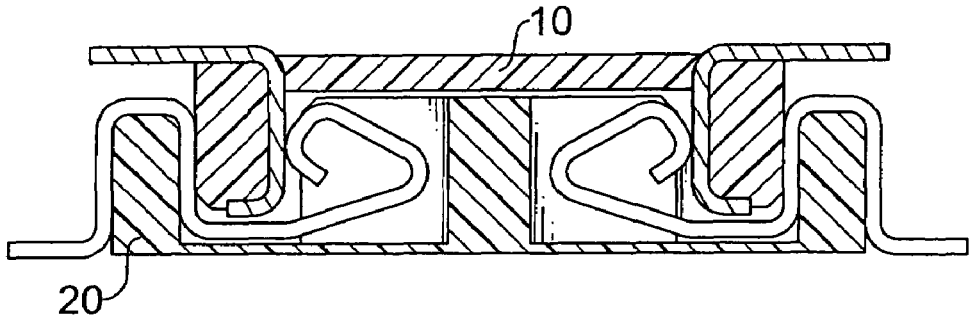
FIG. 9 PRIOR ART
FIG. 9 is a cross sectional end view of a conventional connector assembly in accordance with the prior art with the plug connector engaged loosely with the socket connector.

With reference to FIG. 8, a second embodiment of the connector assembly 50 is similar to the first embodiment and has the socket connector 40*a* being different slightly from that of the first embodiment. The mounting recesses 44*a* of each row are defined in the bottom of one of the sides 43*a* of the second insulative housing 4. The mounting tab 522*a* of the second body portion 52*a* of each second terminal 5*a* protrudes up from the second terminal 5*a* and is mounted in the corresponding through hole 45 through the bottom opening. Two row of shoulder portions 55*a* correspond respectively to the pluralities of the first terminals 2, correspond respectively to the pluralities of the second terminals 5*a*, are formed respectively on and respectively protrudes from the sides 43*a* of the second insulative housing 4. The shoulder portions 55*a* of each row are selectively engaged respectively with the interference portions 26 of the first terminals 2 of a corresponding row.

The secure engagement of the interference portions 26 of the plug connector 30 and the shoulder portion 55, 55*a* of the socket connector 40, 40*a* prevents the plug connector 30 from inadvertently disengaging from the socket connector 40, 40*a* so that signal transmission would be implemented stably via the connector assembly 50.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A connector assembly adapted to be mounted between two printed circuit boards, the connector assembly comprising:

a plug connector having a first insulative housing;

at least one row of first terminals mounted on the first insulative housing and each first terminal having a soldering portion; and a first body portion formed on the soldering portion and having an inside contacting portion formed on and protruding perpendicularly from the soldering portion, a resilient arm portion formed on and protruding from the inside contacting portion, and an interference portion formed on and protruding from the resilient arm portion; and a socket connector engaged selectively with the plug connector and having a second insulative housing;

at least one row of second terminals corresponding respectively to at least one row of the first terminals, the second terminals of each row corresponding respectively to and selectively engaged respectively with the first terminals of a corresponding row and each second terminal having a soldering portion;

a second body portion being m-shaped, formed on the soldering of the second terminal and mounted on the second insulative housing;

a spiral arm portion formed on and protruding from the second body portion and having an upper distal end;

an inner contacting portion formed on the upper distal end of the spiral arm portion and selectively contacting the inside contacting portion of a corresponding first terminal; and a shoulder portion formed on and protruding from the second terminal and engaged selectively with and locking with the interference portion the corresponding first terminal; wherein the second body portion of each second terminal has a crossbar portion formed on and protruding from the soldering portion, and a mounting tab formed on and protruding perpendicularly from the crossbar portion and mounted on the second insulative housing, and the spiral arm portion of each second terminal is formed on and protrudes from the crossbar portion of the second terminal;

the shoulder portion of each second terminal is formed on the second body portion and faces the inner contacting portion;

each first terminal further has a curved and notched portion defined in the first terminal between the inside contacting portion and the resilient arm portion and the resilient arm portion protrudes perpendicularly from the inside contacting portion;

the first insulative housing has two ends, two opposite sides and further has a cavity defined in the first insuluative housing and at least one row of mounting recesses corresponding respectively to the at least one row of the first terminals and the mounting recesses of each row defined in one of the sides;

the first terminal of each row is mounted respectively in the mounting recesses of a corresponding row;

the second insulative housing has two ends and further has two opposite sides and each side having a top and a bottom;

a cavity defined in the second insulative housing and having an inner bottom surface;

a ridge formed on and protruding up from the inner bottom surface of the cavity between the sides of the second insulative housing, selectively extending in the cavity in the first insulative housing and having two opposite sidewalls and at least one row of mounting slots corresponding respectively to the at least one row of the second terminals and the mounting slots of each row defined in one of the sidewalls;

at least one row of mounting recesses corresponding respectively to the at least one row of the mounting slots, corresponding respectively to the at least one row of the second terminals, and the mounting recesses of each row defined in the top of one of the sides of the second insulative housing and aligned respectively with the mounting slots of a corresponding row; and at least one row of through holes corresponding respectively to the at least row of the mounting slots, corresponding respectively to the at least one row of the second terminals and the through holes of each row defined through one of the sides of the second insulative housing and aligned respectively with mounting slots of a corresponding row;

the second terminals of each row are mounted respectively in the mounting recesses of a corresponding row;

the mounting tabs of the second terminals of each row are mounted respectively through the through holes of a corresponding row; and the spiral arm portions of the second terminals of each row extend respectively in the mounting slots of a corresponding row.

2. The connector assembly as claimed in claim 1, wherein:

each through hole has a top opening and a bottom opening; and each mounting tab is mounted in one of the through holes through the top opening.

* * * * *